United States Patent [19]

Matkan

[11] 3,944,355

[45] Mar. 16, 1976

[54] APPARATUS FOR TRANSPORTING AND CHARGING PAPER IN ELECTROSTATIC COPIERS AND THE LIKE

[75] Inventor: Josef Matkan, Malvern, Australia

[73] Assignee: Research Laboratories of Australia, Eastwood, Australia

[22] Filed: Apr. 4, 1974

[21] Appl. No.: 457,724

[30] Foreign Application Priority Data

Apr. 9, 1973 Australia ..... 2930/73

[52] U.S. Cl. ..... 355/3 R; 317/262 A

[51] Int. Cl.[2] ..... G03G 15/02

[58] Field of Search..... 317/262 E, 262 A; 250/324, 250/325, 326; 355/13, 3 R, 3 CH, 3 SH

[56] References Cited

UNITED STATES PATENTS

| | | | |
|---|---|---|---|
| 3,303,401 | 2/1967 | Naumann et al. | 317/262 A |
| 3,456,109 | 7/1969 | Gawron | 355/3 R UX |
| 3,511,564 | 5/1970 | Gawin et al. | 355/3 R |
| 3,800,153 | 3/1974 | Matsumoto et al. | 317/262 A X |
| 3,850,519 | 11/1974 | Weikel | 317/262 A X |
| 3,893,800 | 7/1975 | Wako | 355/3 FU |

*Primary Examiner*—L. T. Hix
*Assistant Examiner*—Kenneth C. Hutchison
*Attorney, Agent, or Firm*—Kinzer, Plyer, Dorn & McEachran

[57] ABSTRACT

In an electrostatic copier particularly of the microfilm reader-printer type an electrically insulating member such as a polyester transport belt is provided onto which an uncharged recording sheet is fed so that no other holding means is required to position the recording sheet at the exposure station, the invention utilizing, at the site of discharging the recording sheet onto the transport belt, a conductive electrode which is interposed between recording sheet and insulating belt to allow a single corona generating device to both apply a surface charge to said recording sheet and assemble it onto the transport belt.

3 Claims, 3 Drawing Figures

APPARATUS FOR TRANSPORTING AND CHARGING PAPER IN ELECTROSTATIC COPIERS AND THE LIKE

BACKGROUND OF THE INVENTION

This invention relates to electrostatic copiers and in particular it relates to an improved method of electrostatically charging, transporting and positioning for the purpose of exposure an electrophotographic recording member in such a copier. Electrostatic copiers are well known, and in general operate in such manner that an electrophotographic recording member is first electrostatically charged on its sensitive surface, following which it is imagewise exposed to form an electrostatic latent image thereon which latent image is subsequently developed by the attraction thereto of electroscopic marking particles. The electrophotographic recording member may typically comprise a paper sheet having coated on one side thereof, that is to say on its sensitive side, a layer consisting of a photoconductor such as Zinc Oxide embedded in an insulating binder material.

Whilst in many electrostatic copiers the original material being copied and the recording sheet move in a synchronous relation during exposure, there are other electrostatic copiers in which the recording sheet remains stationary during exposure. This is the case for instance in microfilm reader-printers where the image contained on a microfilm or microfiche is projected in enlarged form onto an electrostatically charged recording member.

A microfilm reader-printer of this kind is described for instance in U.S. Pat. No. 3,511,564. This microfilm reader-printer contains a transport belt made of an electrically insulating polyester film material. The lower run of such belt is disposed in a substantially horizontal plane to form an exposure station, and accordingly the optical track is so arranged that for exposure purposes an image can be projected onto a focal plane coincident with the belt at said exposure station. The electrophotographic recording sheet is first electrostatically charged by passing it through a set of corona generating devices and subsequently the recording sheet is directed through guide means onto the insulating transport belt. Additional charging means are provided to establish an electrostatic field through which the already charged recording sheet and the lower run of the insulating transport belt are passed thereby to electrostatically assemble the recording sheet onto the belt so that no other holding means is required to position the recording sheet at the exposure station. The exposure then is carried out by projecting an image onto the recording sheet which is electrostatically held onto the lower run of the insulating transport belt which lower run is coincident with the focal plane of the projected image.

It will be seen that there is a disadvantage in the above described method in that there is need for one set of corona generating devices for the purpose of applying an electrostatic surface charge to the sensitive side of the recording sheet as well as for an additional corona generating device for the purpose of electrostatically assembling the already charged recording sheet onto the insulating transport belt. In this configuration it is necessary to use separate corona generating means to apply a uniform surface charge to the recording sheet as it is found that the highly resistive or insulating nature of the transport belt prevents adequate and/or uniform surface charge build-up to occur on the recording sheet when only one corona generating device is used for both surface charging and assembly.

SUMMARY OF THE INVENTION

The object of the present invention is to overcome the aforesaid disadvantage by providing a method whereby one only corona generating means is employed to carry out both functions of applying a surface charge to the recording sheet and assembling the recording sheet onto the insulating transport belt.

A further object of this invention is to provide a method of controlling the degree of adhesion due to electrostatic attraction between the recording sheet and the insulating transport belt.

In carrying this into effect, in accordance with this invention at the site of discharging or directing the recording sheet onto the insulating transport belt an electrode is interposed between the recording sheet and the appropriate run of the insulating transport belt. Such electrode serves the purpose of acting as the counter electrode in relation to the corona generating means in its function of applying a uniform surface charge to the sensitive side of the recording sheet and thus such electrode can be either at ground potential or at some appropriate potential of opposite polarity to that of the corona generating device, depending on the output characteristics of the high tension power supply used. The electrode can be advantageously positioned transversely in relation to the direction of movement of the insulating transport belt and it can be in juxtaposition or in virtual contact with the relevant run of such belt. The length of such electrode in the direction transverse to the movement of the belt can be at least equal to the width of that portion of the recording sheet which is required to be imaged however there may be instances where it is desirable to increase or decrease such length of the electrode.

DESCRIPTION OF THE DRAWINGS

The drawings illustrate various means by which the principles of the present invention may be utilised for the purpose previously described, and although other mechanical configurations may be suggested by those versed in the act, it should be understood that we wish to embody within the scope of the invention all such modified mechanical configurations as reasonably and properly come within the scope of this contribution to the art.

Referring to the drawings.

Figure 1:
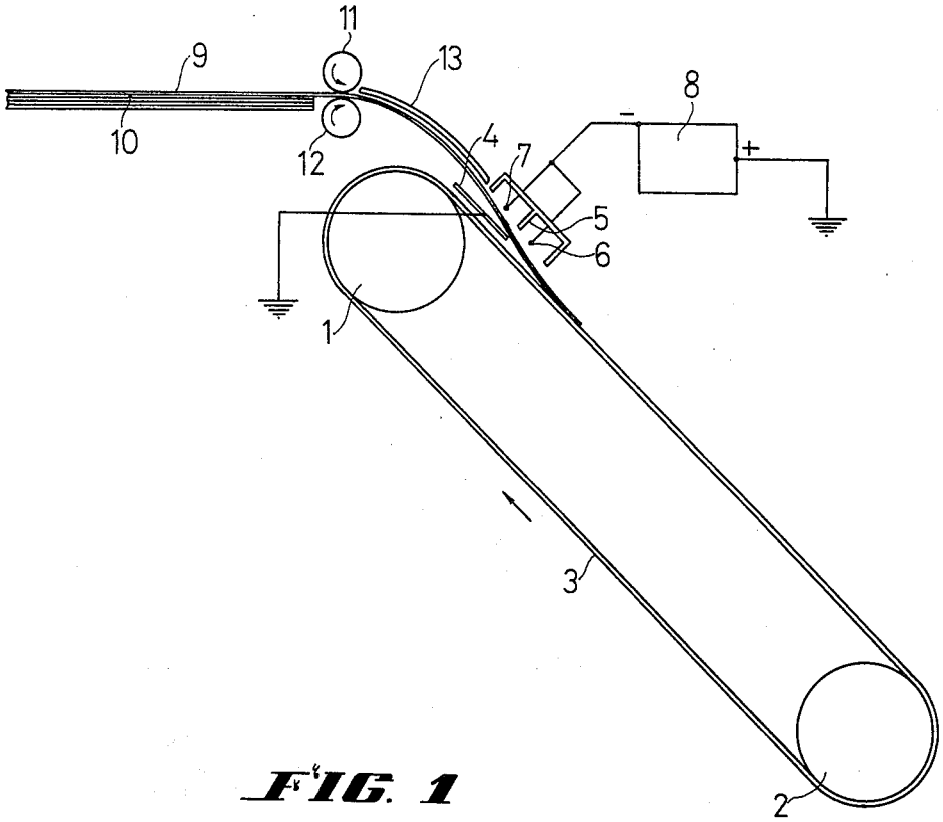
FIG. 1 represents a charging and transport means in which the interposed electrode is in the form of a flat conducting plate, and the corona generating means is a shielded double wire corona unit.
Figure 2:
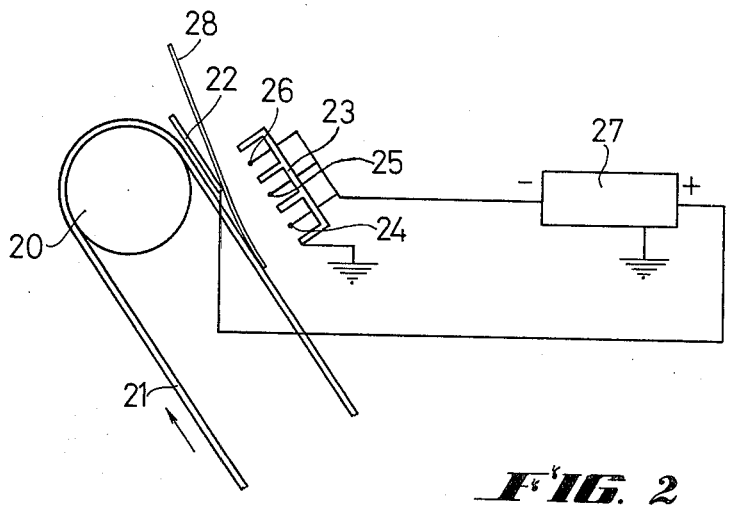
FIG. 2 represents a charging and transport means differing from FIG. 1 in employing a triple wire corona generating means.
Figure 3:
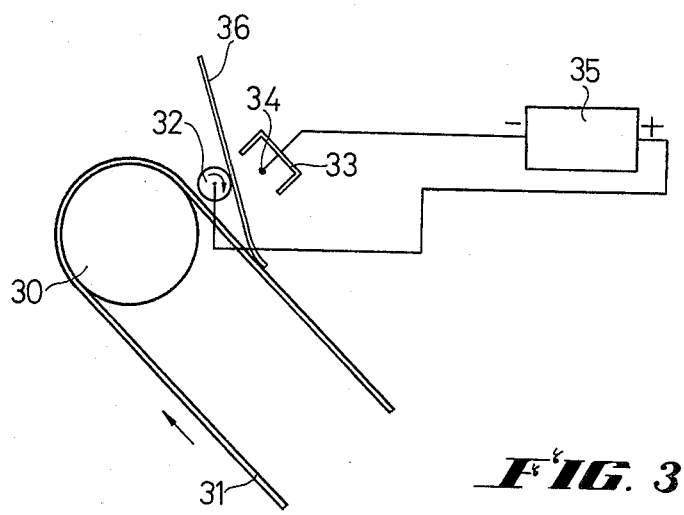
FIG. 3 represents a charging and transport means in which the interposed electrode is in the form of a roller used in conjunction with a single wire corona generating unit.

It will be realised that the corona generating means of FIG. 1 and FIG. 2 could be used in conjunction with the roller electrode of FIG. 3, and the single wire corona unit of FIG. 3 could if desired be used in conjunction with the flat plate electrode of FIGS. 1 and 2.

Referring to FIG. 1 in detail, a charging and transport means with certain ancilliary equipment is shown in which rollers 1 and 2 define the path of insulating transport belt 3, which is caused to move in the direction shown. A flat conductive electrode 4 is placed above insulating transport belt 3 in the general location shown. A corona generating means 5, containing corona wires 6 and 7 is positioned in a spaced apart relation to electrode 4, on the side of electrode 4 opposite to the position of insulating transport belt 3. Corona generating means 5 is so positioned in relation to electrode 4 that the field of influence of corona wire 6 when excited is substantially directed towards insulating transport belt 3, whereas the field of influence of corona wire 7 when excited is substantially directed towards electrode 4.

A recording sheet 9 from stack of recording sheets 10 is directed by driven rollers 11 and 12 towards deflector plate 13 which directs recording sheet 9 towards the gap between electrode 4 and corona generating means 5, driven rollers 11 and 12 continuing their function of moving the recording member 9 forwards until its leading edge contacts insulating transport belt 3. Excitation of corona wires 6 and 7, by switching on of high voltage power supply 8, causes simultaneous charging of recording sheet 9 and adhering of recording sheet 9 to insulating transport belt 3 by electrostatic attraction. In FIG. 1 the electrode 4 is shown to be grounded, but may if desired be at some appropriate potential of opposite polarity to that of the corona generating devices; thus in those instances in which zinc oxide is used as the photoconductor on the sensitive surface of the recording member, the corona voltage will be of negative polarity as shown, and the electrode 4 may be at ground potential or at an appropriate potential of positive polarity.

Referring now to FIG. 2, which only illustrates those features necessary to define the variation between this embodiment and that of FIG. 1, roller 20 is one of a pair which defines the travel path of insulating transport belt 21, which moves in the direction shown. Electrode 22 is positioned adjacent to belt 21 substantially in the position shown. Corona generating means 23, containing corona wires 24, 25 and 26, is positioned in a spaced apart relation with regards electrode 22, and on the opposite side of electrode 22 to that of insulating transport belt 21. Corona wires 24, 25 and 26 are connected to the negative terminal of high voltage power supply 27, and electrode 22 is connected to a positive tapping of high voltage power supply 27. Corona wire 26 is positioned so that its zone of influence when activated is substantially towards electrode 22, whereas corona wire 24 is positioned so that its zone of influence when activated is substantially towards insulating transport belt 21. Corona wire 25 is positioned so that its zone of influence when activated is partly directed towards electrode 22 and partly directed towards insulating transport belt 21. Alteration of the position of electrode 22 along the direction of movement of transport belt 21 alters the proportion of charging field directed towards electrode 22 and insulating transport belt 21, whereby the degree of electrostatic adherence of recording member 28 to insulating transport belt 21 may be adjusted as desired.

In FIG. 3, which illustrates only those features necessary to define the variation between this embodiment and those of FIG. 1 and FIG. 2, roller 30 is one of a pair which defines the travel path of insulating transport belt 31, which moves in the direction shown. Electrode 32 in this instance is in the form of a roller which can rotate in the direction shown to direct recording sheet 36 towards insulating transport belt 31. Corona generating means 33, containing corona wire 34, is adjustably mounted to enable the zone of influence of corona wire 34, when activated, to be directed partly towards electrode 34 and partly towards insulating transport belt 31, in adjustable proportions to control the electrostatic attraction between recording sheet 36 and insulating transport belt 31. Corona wire 34 is connected to the negative terminal of high voltage power supply 35, the positive terminal of which is connected to electrode 32 and grounded.

EXAMPLES

The following examples will serve further to illustrate the principles of this present invention.

EXAMPLE 1

Using the configuration illustrated in FIG. 1, in which the corona wires were positioned 9mm apart from the recording sheet, and a negative potential of 4.5kv was applied to the corona wires with the electrode grounded, a commercially available photoconductive recording member consisting of a paper sheet having coated on its sensitive surface a layer comprising photoconductive zinc oxide and an insulating resin binder, and containing on its unsensitive or obverse side a solvent barrier layer was directed towards the insulating transport belt, so that its obverse side contacted the electrode prior to contacting the insulating transport belt. Thus the sensitive surface of the photoconductive recording member faced the corona wires. Under these conditions, the sensitive surface of the recording member was charged to a negative potential of 220 volts and held to the insulating transport belt by the electrostatic attraction of a surface charge of 1500 volts thereon. The insulating transport belt was endless, and comprised a continuous polyester belt, 0.006 inch thick. The electrostatic attraction was sufficient to hold the paper at the focal plane of a projected image for sufficient time to allow the formation of an electrostatic latent image by projection, and the developed image was found to be of excellent contrast and definition.

EXAMPLE 2

Example 1 was repeated, using the configuration illustrated in FIG. 2. Electrode 22 was positioned so that its leading edge was adjacent to the center wire of the three corona wires. The photoconductive recording member was charged to a negative potential of 220 volts and held to the transport belt by the electrostatic attraction of a surface charge of 1500 volts thereon.

EXAMPLE 3

Example 2 was repeated, with the exception that the electrode was moved ⅛ inch in a direction opposite to that of the movement of the transport belt, to allow the establishment of a surface potential of 1700 volts on the surface of the transport belt. The negative potential on the photoconductive recording member charged under these conditions was still found to be 220 volts.

EXAMPLE 4

Example 1 was repeated using the configuration illustrated in FIG. 3. The rotating electrode was ¼ inch diameter, and a single wire corona charging device was used. Other conditions were as in Example 1, and in this instance the photoconductive recording member was also charged to a negative potential of 220 volts, but held to the insulating transport belt by the electrostatic attraction of a surface charge of 1400 volts thereon.

Thus it will be seen that the present invention allows the charging the positioning of photoconductive recording sheets in a simple and effective manner, and further allows simple means for the adjustment of the degree of electrostatic attraction between the recording sheet and the transport or positioning member to allow for subsequent removal of the recording sheet from the transport belt for image development, where such adjustment of the degree of electrostatic attraction can be controlled by varying the position of the corona generating device in relation to the counter electrode to thereby vary the proportion in which the total zone of emission influence from the corona generating device is divided between that part of the recording sheet which overlies the electrode and that part of the recording sheet which overlies the insulating transport belt.

I claim:

1. In a copying apparatus wherein an electrostatically chargeable endless belt made of electrically insulative material is trained over a pair of spaced rollers to provide a run forming a flat focal plane defining an exposure zone and wherein means are provided to feed an uncharged photoconductive recording member, having a sensitive side and a non-sensitive side, onto said belt for transport to said exposure zone, means for charging said photoconductive recording member simultaneously with adhering said non-sensitive side of said photoconductive recording member onto said insulative belt, by an electrostatic surface charge applied to the belt, said charging means being a single electrical couple which itself consists essentially of (1) a corona generating means, juxtaposed closely adjacent said insulative endless belt in position to charge the belt and (2) an electrode positioned between said insulative endless belt and the feed path of said photoconductive recording member, said electrode being positioned in virtual contact with said insulative endless belt on the same side of the belt as said corona generating means and extending transverse to the direction of movement of said endless belt, said electrode further being positioned in the feed path of the recording member to contact said non-sensitive side of said photoconductive recording member before said non-sensitive side of said photoconductive recording member is fed on to said insulative endless belt, said corona generating means and the electrode being the sole means for both charging the belt and the recording member simultaneously.

2. In the copying apparatus as defined in claim 1, the provision of said electrode in a substantially planar form, mounted transverse to the direction of travel of said insulative endless belt.

3. In the copying apparatus as defined in claim 1, the provision of said electrode as a freely rotating roller mounted transverse to the direction of movement of said insulative endless belt.

* * * * *